United States Patent [19]

Vetter

[11] 4,296,588

[45] Oct. 27, 1981

[54] SEALING STATION OF VACUUM PACKAGING MACHINES

[75] Inventor: Artur Vetter, Wolfertschwenden, Fed. Rep. of Germany

[73] Assignee: Multivac Sepp Haggenmuller KG, Fed. Rep. of Germany

[21] Appl. No.: 79,043

[22] Filed: Sep. 26, 1979

[30] Foreign Application Priority Data

Oct. 7, 1978 [DE] Fed. Rep. of Germany ..... 2843894

[51] Int. Cl.[3] ..... B65B 31/02

[52] U.S. Cl. ..... 53/86; 53/510

[58] Field of Search ..... 53/86, 510–512; 92/98 R

[56] References Cited

U.S. PATENT DOCUMENTS 3,832,828 9/1974 Martin ..... 53/511
3,992,850 11/1976 Vetter ..... 53/510
4,038,506 7/1977 Filip ..... 92/98 R X

FOREIGN PATENT DOCUMENTS 244177 5/1969 U.S.S.R. ..... 53/511

*Primary Examiner*—Robert D. Baldwin
*Attorney, Agent, or Firm*—Donald Brown

[57] ABSTRACT

A vacuum packaging machine for producing sealed vacuum packages is disclosed which includes an improved sealing station. The sealing station has a heatable sealing member and a backing member for co-operation therewith, and deflector means are associated with the scaling member to deflect the air and moisture sucked off from the evacuating chamber of the evacuating and sealing station in operation in order to direct said air and moisture away from the sealing member to avoid contact therebetween, so that the air and moisture contained therein will substantially not be heated by the sealing member which is heated in operation. As a result, the moisture contained in the air sucked off from the evacuating chamber will not expand under the action of heat from the sealing member, and a substantially better vacuum will be achieved with the same capacity of the evacuating system.

18 Claims, 4 Drawing Figures

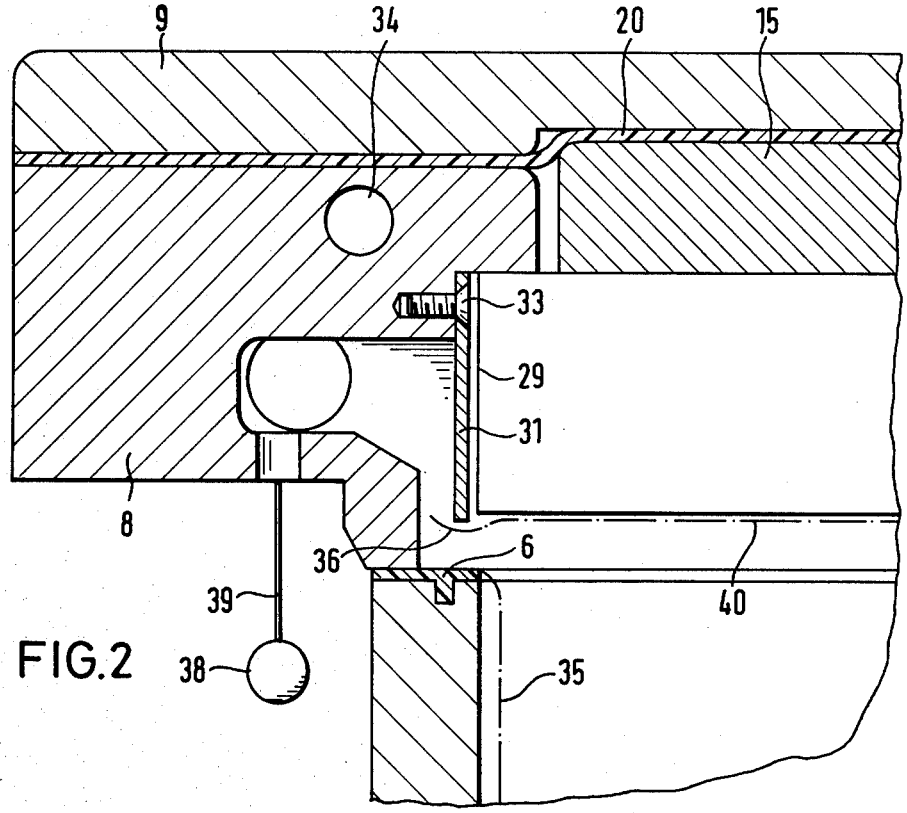
FIG.2
FIG. 4
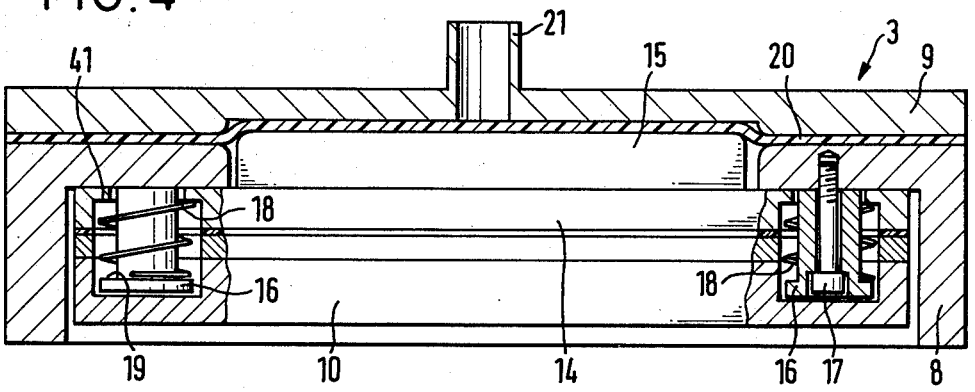

SEALING STATION OF VACUUM PACKAGING MACHINES

BACKGROUND OF THE INVENTION

This invention relates to vacuum packaging machines in general, more particularly to an improved sealing and evacuating station for vacuum packaging machines for producing sealed vacuum packages.

German published patent specification (Auslegeschrift) No. 1,939,216 discloses an evacuating and sealing station for vacuum packaging machines having upper and lower station portions, a heatable sealing member in one of said portions and a backing member in the other of said station portions, the sealing member and backing being movable one with respect to each other, an evacuating chamber being defined by the upper and lower station portions which is connected with a suction port connected with an evacuating system to evacuate the chamber in operation. The sealing member provided in the upper station portion may be moved by a pneumatic piston and cylinder device towards the backing and away therefrom in order to perform the sealing operation. The evacuation is performed through a suction port provided in a cover arranged over the sealing member. The air which will be sucked off from the evacuating chamber will flow across the edge portions of the heated sealing member.

Particularly when packaging food products with high water content, e.g. fresh meat, the generation of a high vacuum will produce large amounts of water vapour the volume of which will be multiplied by heating the water vapour upon contacting the heated sealing member. This seriously affects the evacuating operation and will result in either poor vacuum or the requirement of substantially increased capacity of the evacuating system.

The German utility model No. 7,221,634 discloses a similar device which is provided, on at least one side between the upper and lower packaging material foils, with a nozzle arrangement for supplying e.g. water vapour. If the upper packaging material foil is larger than the vacuum chamber, evacuation is performed through the nozzle arrangement, and simultaneously evacuation is performed through a connecting sleeve, because otherwise, the foils would contract and expel the material to be packaged because of the higher pressure in the upper chamber. In order to be able to provide the nozzle arrangement on one side between upper and lower foils, the upper foil is bulged upwardly in the region of the nozzle arrangement and towards the normal plane in the region of the sides. During evacuation, the aspirated gas or air will flow across the sealing member and be heated thereby, resulting in an increase of its volume requiring longer evacuation times at given capacity of the evacuation system.

OBECTS OF THE INVENTION

It is a primary object of the invention to provide an improved evacuating and sealing station for a vacuum packaging machine.

It is a further object of the invention to provide an improved evacuating and sealing station for a vacuum packaging machine which will prevent heating of the aspirated gas by contacting the sealing member during evacuation, thereby reducing the volume of gas to be evacuated.

It is a still further object of the invention to provide an evacuating and sealing station for a vacuum packaging machine providing a high vacuum of the order of 1 mbar or less, at moderate capacity of the evacuating system.

It is a still further object of the invention to provide an evacuating and sealing station for a vaccum packaging machine allowing sealed evacuated packages of products with high water content such as meat to be produced with reduced evacuating requirements.

SUMMARY OF THE INVENTION

These and further objects of the invention are achieved by an improved evacuating and sealing station for use in a vacuum packaging machine for producing sealed vacuum packages comprising upper and lower station portions, a heatable sealing member in one of said upper and lower station portions, a backing member in the other of said upper and lower portions, the sealing member and backing member being movable towards and away from each other, and an evacuating chamber defined by the upper and lower station portions, wherein deflector means are associated with the sealing member in such a way as to deflect the gas flowing out from the evacuating chamber during evacuation away from the sealing member to avoid contact therebetween and thus heating of the gas and moisture contained therein. By preventing the gas and moisture to contact the heated sealing member, they will remain at lower temperatures and therefore will not have an increased volume. This provides a considerable gain in evacuation time, and consequently, higher production rates.

In a preferred embodiment of the invention the evacuation is performed through a passage provided laterally from the sealing member, such passage extending substantially over the entire width of the evacuation chamber. This will provide lower flow resistance and therefore high evacuation speed. Further, the air to be aspirated will not flow between the cover plate and the back side of the sealing member, and this will further result in avoiding pieces of packaging material or of the product to be packaged which may be entrained by the aspirated gas to reach the region between the cover plate and the back side of the sealing member.

Preferably, the sealing member is moved by a diaphragm adapted to be solicited by a pressure medium from a retracted position into a sealing position adjacent the backing member, the diaphragm being clamped between an upper housing and the cover plate of the upper portion of the sealing station. The diaphragm extends over substantially the entire cross sectional area of the sealing member. This will provide an extremely simple and efficient sealing of the station which is important for producing packages under high vacuum.

BRIEF DESCRIPTION OF THE DRAWINGS

Further objects and features of the invention will be apparent from the following description of several embodiments of the invention in connection with the accompanying drawings. It should be understood that this description is in no way limitative and that various changes may be brought to the disclosed embodiments without departing from the scope of the invention.

In the drawings:

FIG. 2 a more detailed view of part of the embodiment shown in FIG. 1 on a larger scale;

FIG. 4 shows a cross sectional view of the upper portion of the vacuum station normally to the sectional direction of FIG. 1.

Figure 1:
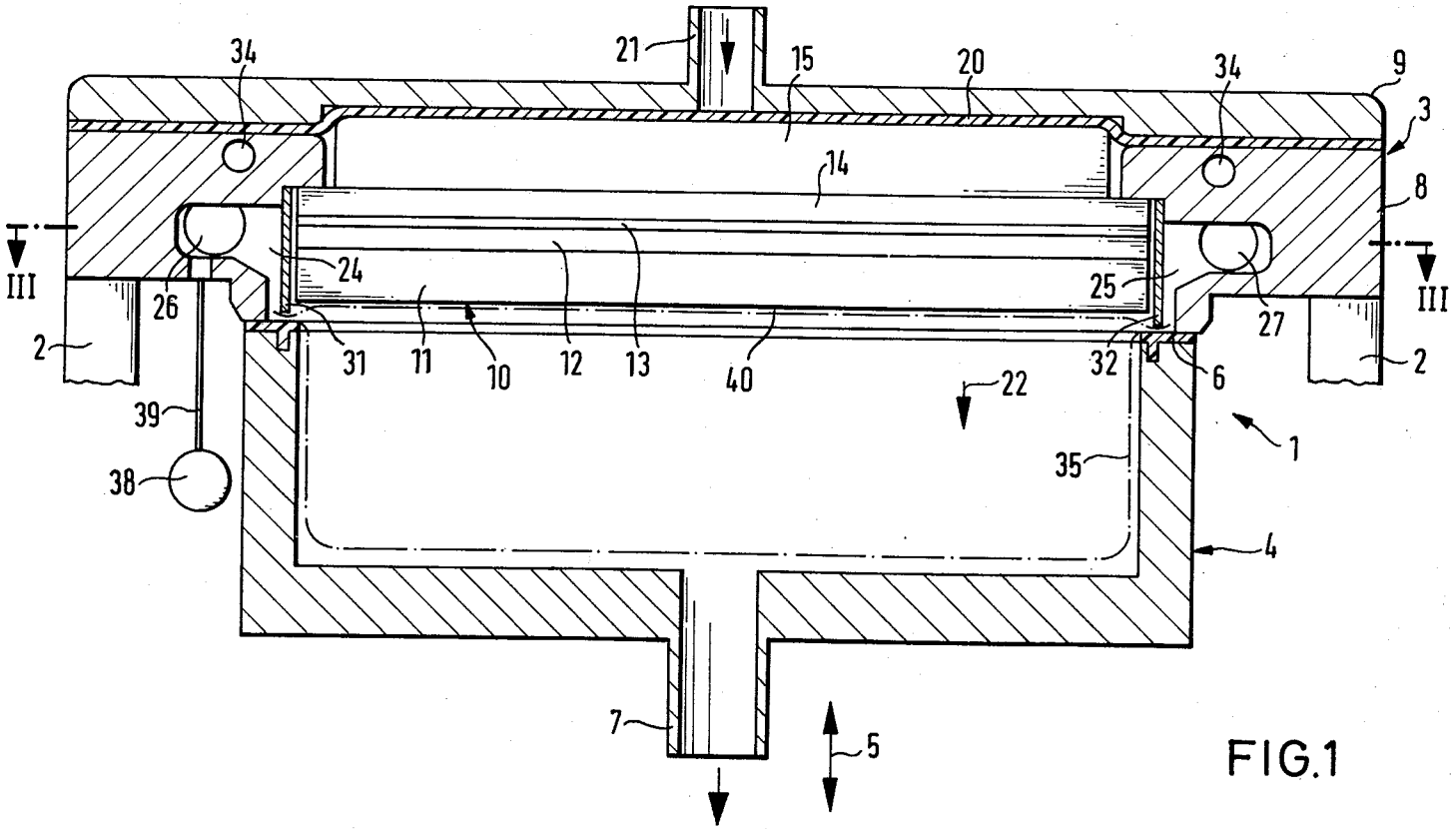
FIG. 1 is a cross sectional view of one embodiment of the vacuum station.

Referring to the drawings, the evacuating and sealing station 1 has an upper station portion 3 and a lower station portion 4. The upper station portion is mounted to a machine frame 2. The lower portion 4 is connected with a piston-cylinder device (not shown) for raising and lowering the same in the direction of arrow 5 with respect to the upper portion. The lower station portion is provided with a backing 6 formed of a resilient layer which is arranged on the face of the lower portion opposite the upper portion. The space within the lower portion is connected with an evacuating pump through an aspirating sleeve 7 provided at the bottom of the lower station portion.

The upper station portion 3 is provided with a housing 8 and a cover plate 9. A sealing member 10 is provided within the housing. The sealing member 10 has a continuous sealing plate 11, heating members and a plate 12 arranged there-above and connected with the sealing plate 11 through bolts or screws. The sealing member further includes an isolating strip 13 of silicone material, an intermediate plate 14 and a back plate 15. This structure forms a sealing frame which is connected with the plates 11 and 15 through bolts or screws.

FIG. 4 shows the connection of the sealing member 10 with the housing 8. The intermediate plate 14 applied against the housing from below at its sides is provided with a bore on both sides respectively receiving a hollow stepped stud 16 mounted on the housing 8 by means of a bolt 17. A compression spring 18 is disposed around the stepped hollow stud 16 applying against the lower side of the stepped portion 19 of the stud 16 at one of its ends and against the wall of a recess 41 in the intermediate plate 14 with its other end.

A diaphragm 20 is provided which applies against the upper face of the plate 15 and extends over the entire upper face of the housing 8, being clamped between the housing 8 and the cover plate 9. Housing 8 and cover plate 9 are screwed together, thereby maintaining the diaphragm in position. On the center portion of the cover plate 9 a connecting stud 21 is provided which may be connected to a pressure medium feed through a feed line not shown in the drawings. When the pressure medium is supplied through the connecting stud 21, the sealing member 10 will be moved by the diaphragm 20 in the direction of arrow 22 towards the backing 6, thereby biasing the compression spring 18. When the supply of pressure medium is stopped, the biased compression spring 18 will urge the sealing member 10 back into its position shown in FIG. 4.

Figure 3:
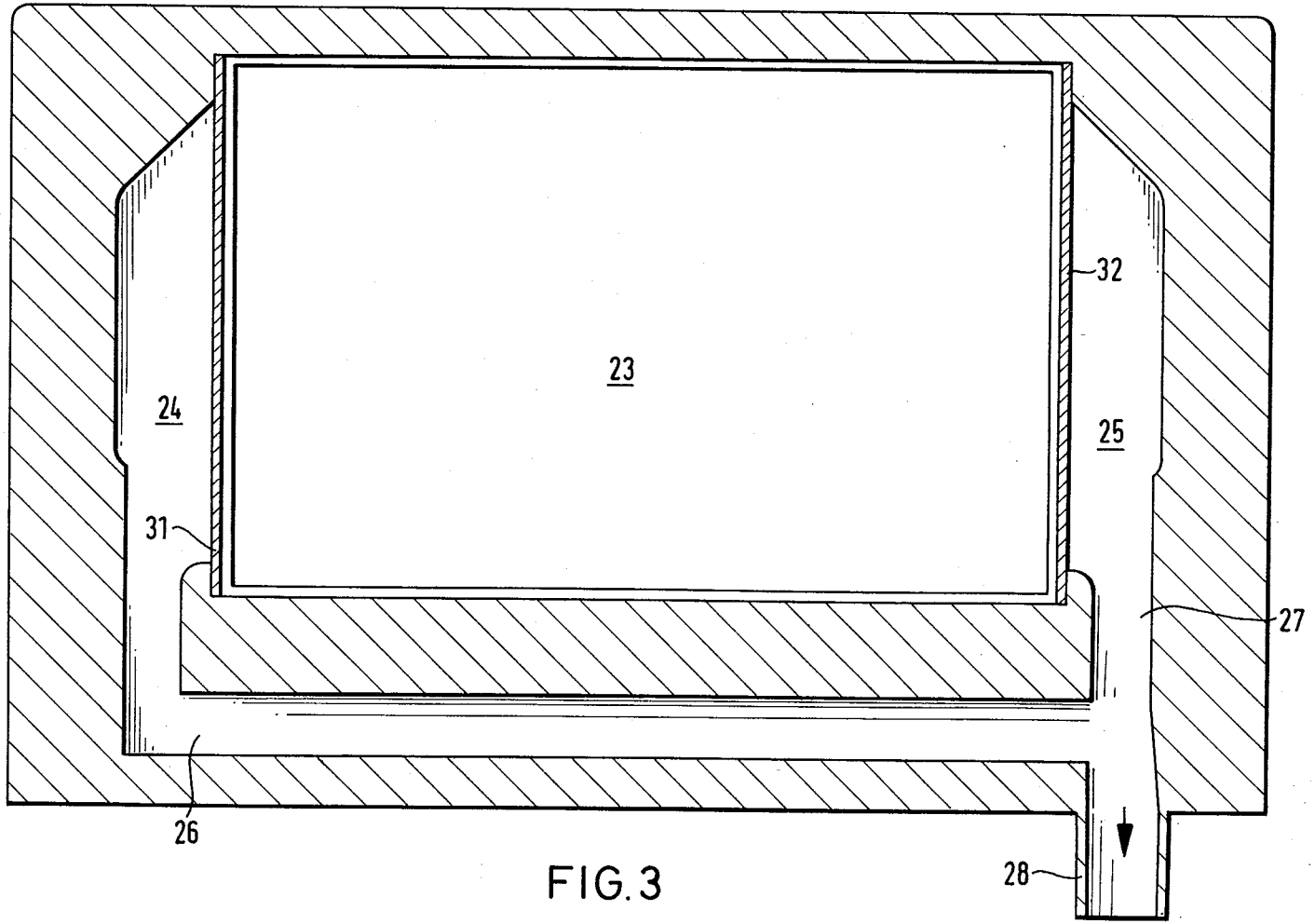
FIG. 3 shows a cross sectional view along line III—III in FIG. 1.

As best shown in FIG. 3, passages 24, 25 are provided on opposed sides of the housing 8, extending over substantially the entire width of the evacuating chamber 23. These passages 24, 25 open into suction bores 26, 27 leading towards a connecting stud 28 which may be connected with an evacuating pump through a conduct not shown in the drawings. The passages extending over the entire width of the cross sectional area of the chamber will result in uniform and quick evacuation due to the large cross sectional area.

As best shown in FIG. 2, the lateral edges 29, 30 of the sealing member 10 adjacent the passages 24, 25 are covered by deflector members 31, 32. Each of these deflector members may be formed by an aluminum sheet connected with the housing 8 through bolts 33 and at least partially contacting such housing. The dimensions of the deflector member are so selected as to extend over the entire width of the respective channel 24, 25, as shown in FIG. 3. As best shown in FIGS. 1 and 2, the vertical dimension of the deflector member is so selected that in the retracted position of the sealing member 10 shown in these figures, the deflector members will slightly project over the lower face of the sealing member. Contacting of the deflector members against the wall of the housing 8 will achieve heat dissipation from the deflector members, such housing being refrigerated by water flowing through water channels 34; the housing may also be made from aluminum.

In operation, a lower packaging material foil 35 forming a packaging container will be clamped at its entire periphery between the upper and lower portions 3, 4. An upper packaging material foil 40 which, in the illustrated embodiment, is narrower than the inner chamber, is applied with its lateral edges 36, 37 onto the deflector members 31, 32. In this way, upon evacuation through the passages 24,25, the air stream will be deflected away from the sealing member 10 rather than flowing across the edges 29, 30. If the aspirated air and moisture contained therein would contact these edges which may be heated to temperatures of 170° C. or more, they would assume a much larger volume producing stagnant pressure in this zone. By avoiding contacting of the aspirated air and moisture with the heated sealing member, and, more particularly, the lateral edges 29, 30 thereof, such increase in volume will be avoided, thereby substantially increasing the evacuating speed and degree of evacuation.

A superior and faster evacuation may also be achieved with upper packaging material foils the width of which exceeds the width of the chamber and which is uniformly clamped between the upper and lower portions 3, 4. To this end, for evacuation, the upper packaging material foil is perforated at its edges.

As best shown in FIG. 2, the achieved vacuum may be measured by a pressure meter 38 connected with passage 24 through a conduct 39. Therefore, the vacuum is not measured in a region of flowing air, so that flowing effects will not spoil the measurements.

The above disclosed evacuation and sealing station will permit obtaining an excellent vacuum of the order of 1 bar, preferably 0.5 bar or less, in an exceptionally short time. There are no sealing problems which are usually encountered with the moving mechanisms of the sealing member. No stagnant or back-up pressure by vapour generation upon contacting of the aspirated air with the hot sealing member will be observed. A further advantage of the quick vacuum generation is a much longer conservation of packaged food.

It should be understood that many modifications may be brought to the embodiments disclosed above by the skilled person without departing from the spirit of the invention.

What is claimed is:

1. A vacuum packaging machine for producing sealed vacuum packages having an evacuating and sealing station comprising first and second station portions, a heatable sealing member in said first station portion, means for cooling a portion of said first station portion, a backing member in said second station portion, said sealing member and backing member being movable toward and away from each other, means for moving the sealing member and backing member toward and away from each other, an evacuating chamber defined by said first and second station portions, said evacuating chamber being connected with evacuating means through suction opening means and deflector means to deflect, in operation, a fluid stream sucked off from said evacuation chamber under the action of said evacuation means away from said sealing means, said deflecting means being connected to said first station portion.

2. The improvement of claim 1, wherein said deflector means extends beyond the face of the sealing means into said fluid stream flowing towards said suction opening means.

3. The improvement of claim 1, wherein said deflector means covers at least a ridge portion of said sealing member.

4. The improvement of claim 1, wherein a fluid passage is provided laterally from said sealing member, connecting said evacuating chamber with said suction opening means.

5. The improvement of claim 4, wherein said fluid passage extends across substantially one lateral side of said evacuating chamber.

6. The improvement of claim 1, wherein said deflector means is connected through thermally conducting means with a cooled wall portion of one of said upper and lower station portions.

7. The improvement of claim 1, wherein means are provided for moving said sealing member from a position separated from said backing member into a sealing position adjacent said backing member, said moving means including diaphragm means extending over substantially the entire surface of said sealing member and being adapted to be solicited by a pressure medium.

8. The improvement of claim 1, wherein means are provided for measuring the vacuum pressure within said evacuating chamber, said measuring means being arranged at a position where substantially no flowing of said fluid will occur in operation.

9. The improvement of claim 1 wherein said deflector means extends beyond the face of the sealing means into said fluid stream flowing towards said suction opening means.

10. The improvement of claim 1 wherein said deflector means covers at least a ridge portion of said sealing member.

11. The improvement of claim 1 wherein a fluid passage is provided laterally from said sealing member, connecting said evacuating chamber with said suction opening means.

12. The improvement of claim 1 wherein said deflector means is connected through thermally conducting means with a cooled wall portion of one of said upper and lower station portions.

13. The improvement of claim 1 wherein means are provided for moving said sealing member from a position separated from said backing member into a sealing position adjacent said backing member, said moving means including diaphragm means extending over substantially the entire surface of said sealing member and being adapted to be solicited by a pressure medium.

14. The improvement of claim 1 wherein means are provided for measuring the vacuum pressure within said evacuating chamber, said measuring means being arranged at a position where substantially no flowing of said fluid will occur in operation.

15. Apparatus according to claim 1 wherein air pressure is applied to the heat sealing member to effect movement thereof through a port in the upper station portion at the back side of the heat sealing member by way of a diaphragm positioned between the port and the back side of the heat sealing member, said diaphragm being sealed all around and being displaceable by air pressure supplied through said port to apply pressure to the heat sealing member without loss of the vacuum.

16. In a vacuum packaging machine for producing sealed vacuum packages having an evacutating and sealing station comprising first and second station portions, said first station portion being thermally conductive, a heatable sealing member in the first station portion, a backing member in the second station portion, said sealing member and backing member being movable toward and away from each other, means for effecting movement of said sealing member and backing member toward and away from each other, an evacuating chamber defined by said first and second station portions, said evacuating chamber being connected with evacuating means through suction opening means, and deflector means to deflect, in operation, a fluid stream sucked off from said evacuating chamber under the action of said evacuating means, away from the sealing member, the said deflector means being connected to said first thermally-conducting station portion and said deflecting member having no contact with said sealing member to avoid heat transfer from said sealing member.

17. In a vacuum packaging machine, upper and lower parts, a backing member in one of the parts, a heat sealing member in the other of the parts, said parts being relatively movable and defining when interengaged an evacuation chamber, said heat sealing member being movable relative to its part to an extended heat sealing position with respect to the backing member in its part, porting means in the one part through which fluid can be exhausted from the evacuation chamber preparatory to heat sealing, means defining an inlet port in the other part through which air under pressure can be let into the evacuation chamber behind the sealing member to extend the heat sealing means to heat sealing position, a flexible diaphragm situated between the inlet port and the back side of the heat sealing member which permits air pressure to be applied to the heat sealing member without loss of evacuation of the vacuum chamber and metallic deflector means fastened to the housing in heat-conducting relation thereto with portions interposed between the sealing member and the porting means.

18. A vacuum packaging machine according to claim 17 wherein there are refrigeration passages in the housing through which a cooling fluid is flowed to cool the housing, an evacuating passage through which the fluid is exhausted from the vacuum chamber, deflector means positioned between the sealing member and the evacuating passages and constituting one side of the vacuum passages and means securing the deflector means in heat-transmitting engagement with the housing.

* * * * *